United States Patent [19]

Powers, Jr.

[11] Patent Number: 4,757,656

[45] Date of Patent: Jul. 19, 1988

[54] LINTEL SYSTEM

[76] Inventor: John A. Powers, Jr., 4608 N. 65th St., Scottsdale, Ariz. 85251

[21] Appl. No.: 122,778

[22] Filed: Nov. 19, 1987

[51] Int. Cl.[4] ..... E04B 2/54; E06B 1/00

[52] U.S. Cl. ..... 52/204; 52/228; 52/300

[58] Field of Search ..... 52/204, 206, 227, 228, 52/211, 300

[56] References Cited

U.S. PATENT DOCUMENTS

| | | | |
|---|---|---|---|
| 2,325,614 | 8/1943 | Klaber | 52/204 |
| 2,627,176 | 2/1953 | Levy | 52/228 |
| 3,296,758 | 1/1967 | Knudsen | 52/227 |
| 3,334,455 | 8/1967 | Russell | 52/227 |
| 3,378,969 | 4/1968 | Larger | 52/228 |
| 3,893,274 | 7/1975 | Salisbury | 52/300 |
| 4,020,612 | 5/1977 | Welch | 52/339 |
| 4,703,602 | 11/1987 | Pardo | 52/227 |

FOREIGN PATENT DOCUMENTS

| | | | |
|---|---|---|---|
| 588383 | 2/1959 | Italy | 52/228 |
| 634887 | 3/1950 | United Kingdom | 52/228 |

*Primary Examiner*—John E. Murtagh

*Attorney, Agent, or Firm*—Don J. Flickinger; Jordan M. Meschkow

[57] ABSTRACT

A lintel system includes a steel flange plate adapted to rest on the wall adjacent both sides of an opening to be spanned, a steel reinforcing structure integral with the flange plate and steel primary reinforcing rods welded to the reinforcing structure and extending upwardly. After the flange plate has been emplaced, two courses of masonry blocks are laid to encompass the primary reinforcing rods. Different embodiments of the invention employ different upper structures. In a first embodiment, a wooden beam directly overlays the upper plate, and each includes apertures generally aligned with and larger than the primary reinforcing rods, each of which is threaded to receive a nut along its terminal portion such that the nuts may be tightened to compress the lintel system into a rigid structure. In the second embodiment, the lintel system also includes secondary reinforcing rods welded to the lower face of the upper plate and extending downwardly into the interior space of the masonry blocks. Upwardly directed steel studs are welded to the upper face and extend through the apertures in the beam and the top plate such that nuts may be tightened to compress the lintel system into a rigid structure. A charge of mortar is introduced into the space within the masonry block courses to envelop the portions of the reinforcing rods disposed in the space.

8 Claims, 2 Drawing Sheets

FIG. 2
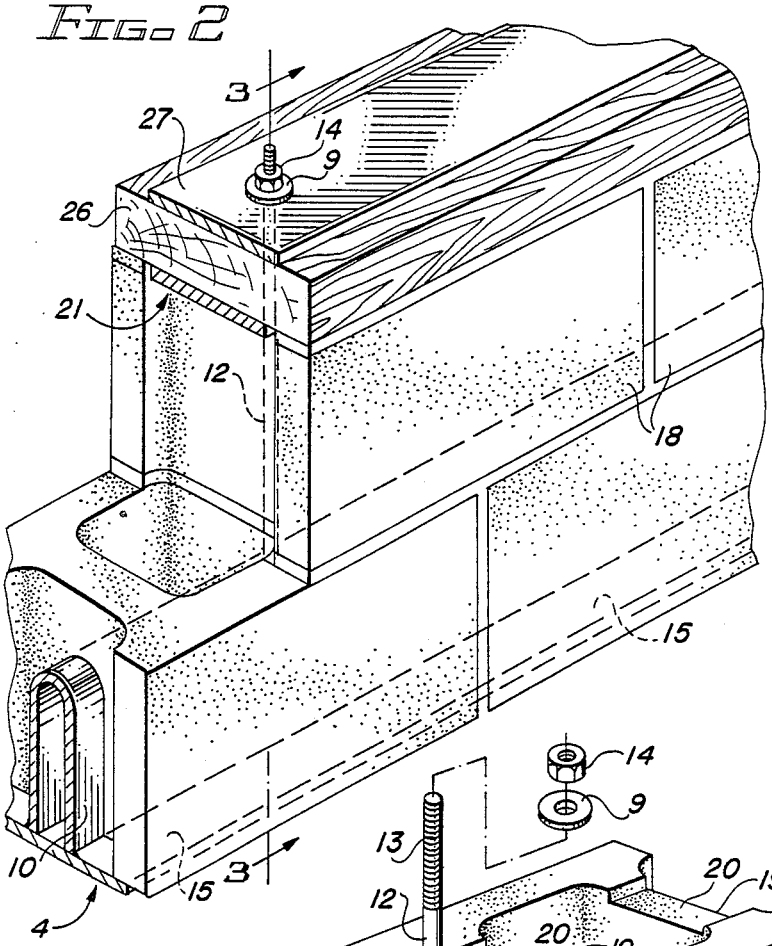
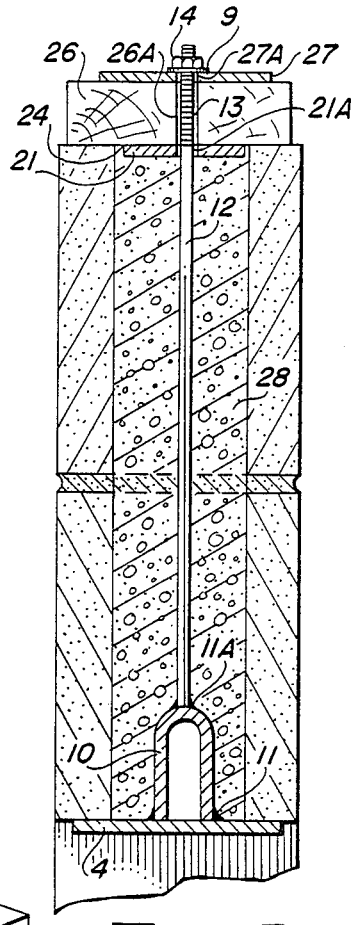
FIG. 3
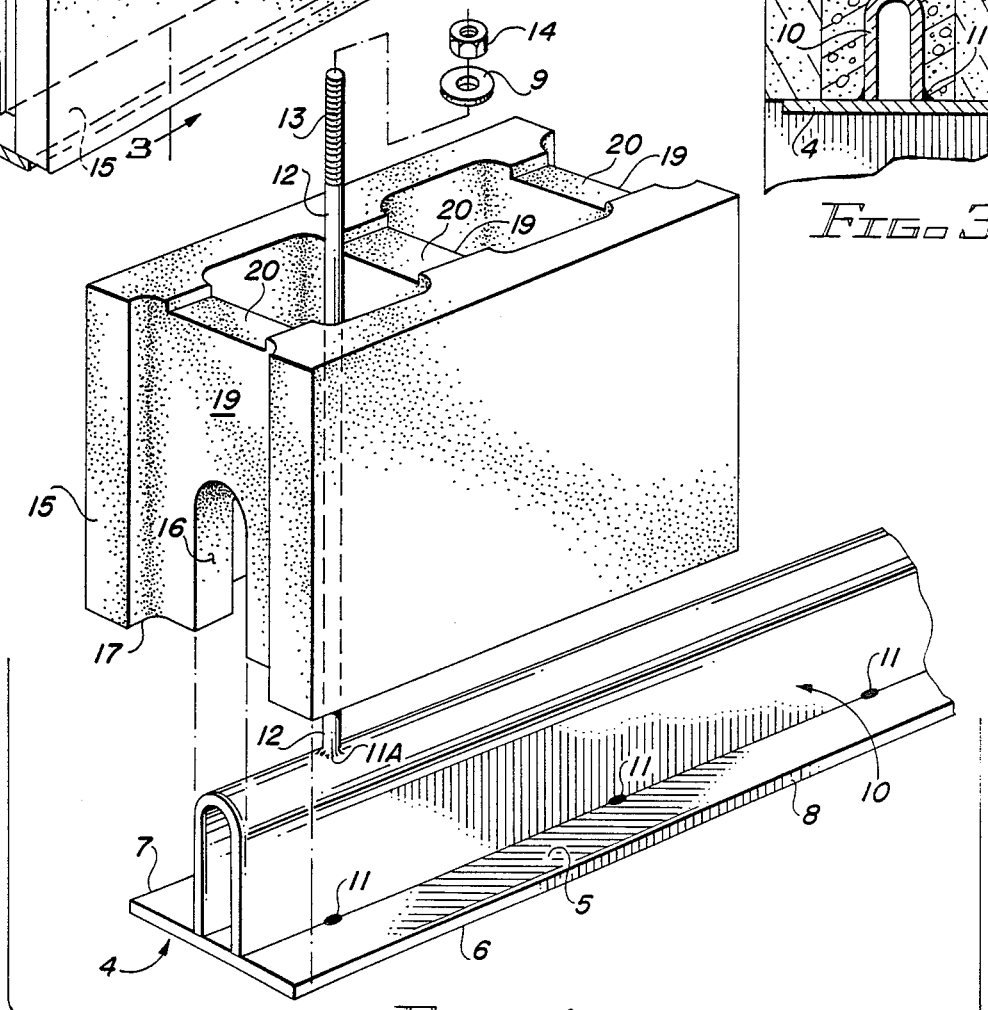
FIG. 4

LINTEL SYSTEM

BACKGROUND OF THE INVENTION

1. Field of the Invention

This invention relates to the field of masonry building construction and, more particularly, to lintels used to span the top of openings in a masonry wall to supply superincumbent support for the weight of upper structures.

2. The Prior Art

In masonry construction, precast lintels are often used to span the opening over doors and windows and to provide superincumbent support for the subsequently emplaced building structure over the opening. However, particularly for spanning relatively lengthy openings as may be encountered, merely by way of example, in the construction of a garage door opening, the load-bearing requirements preclude the use of precast lintels. Stronger lintels of higher load-bearing capacity may be constructed "in place" by providing a temporary or permanent support frame as the lintel is fabricated from masonry blocks. Typically, in such a case, special masonry blocks, each having an elongated cavity opening inwardly along the full length of its lower surface and having an inverted "U" cross section, are then used as the lintel after being filled with concrete reinforced with steel bars. The need to provide a framework for the special lintel blocks is time consuming, whereas, on site construction may leave much to be desired in achieving the required load bearing capacity of the fabricated lintel.

In recognition of these problems, in order to eliminate the need for framework structures and to assure construction of lintels having known load-bearing capacity, contractors often resort to built up lintels utilizing an internal reinforcing steel structure which bridges the opening and provides the necessary support for the masonry blocks utilized to complete the lintel. Several forms of this type construction are known. A first, made of 12–14 gauge steel, comprises an inverted "U"-shape section joined (as by welding) to a relatively wider base support flange member which acts as a broad bearing surface and rests on the masonry on opposite sides of the opening to be spanned. Gusset plates may be provided for added structural rigidity to increase the load bearing capacity. However, the welding of the gusset plates into position requires a significant amount of hand labor and set up time. The process is, as a result, very time consuming and expensive. A second known lintel preform has the general shape of an "I"-beam and includes two horizontal flanges joined by a vertical web. In this case, the web is usually constructed of 12–14 gauge steel; however, the thickness of the horizontal flanges may vary from less than ⅛ inch to more than ½ inch, depending on the length of the span to be bridged and the requisite load-bearing capacity. Thus, the manufacturer of such lintel preforms requires multiple set ups and manual operation which is, again, both time consuming and expensive.

With either construction, the base flange rests at both ends on masonry adjacent the span to be bridged. The preform is then encased in special masonry units which define the exterior dimensions of a built-up lintel. The space between the inner surfaces of the masonry units and the outer surface of the lintel preform is then filled with mortar.

Despite the increased convenience and assurance provided by the use of the self-bridging, reinforced steel forms, such steel bridging forms represent, in and of themselves, a significant expenditure of time and effort in their fabrication. It is also well recognized in the prior art that various modifications must be made to the reinforcing steel bridging structure as the width of the opening to be bridged and the bearing load to be supported increases. Frequently, in cases of long spans or high bearing loads, the contractor is forced to practice a form of "over-kill" by selecting the bridging/reinforcing structures available to him. He will often have to resort to a much heavier and stronger structure than is necessary, because there is no structure of intermediate design available to meet his construction criteria.

Thus, it will be apparent to those skilled in the masonry construction art that it would be highly desirable to provide a lintel system characterized by relative simplicity of construction, very high load-bearing strength and adaptability to providing superincumbent support for spans of different lengths and to accommodate different load bearing requirements. It is to these ends that this invention is directed.

OBJECTS OF THE INVENTION

It is therefore a broad object of this invention to provide an improved lintel system.

It is another object of this invention to provide a lintel system of which principal components may be substantially prefabricated off-site for final assembly on-site.

It is yet another object of this invention to provide such a lintel system which is very strong and is particularly well adapted for spanning large distances.

It is a still yet further object of this invention to provide such a lintel system which, when completed, becomes integral with at least a portion of the superincumbent load as a unitary rigid structure.

SUMMARY OF THE INVENTION

Briefly, these and other objects of this invention are achieved by a lintel system which includes: a steel flange plate adapted to rest on the wall adjacent both sides of an opening to be spanned, a steel elongated reinforcing structure integral with the flange plate and having a cross section generally in the shape of an inverted "U" and a plurality of steel primary reinforcing rods welded to the reinforcing structure and extending vertically upwardly. After the flange plate has been emplaced, a first course of masonry blocks is laid over it in such a manner that the primary reinforcing rods are encompassed along the lower portion of their respective lengths. The first course employs special lintel masonry blocks which have an elongated cavity opening along the full length of their lower surfaces, the cavity having an inverted "U" cross section and being dimensioned and configured to receive the reinforcing structure with clearance. A second course of masonry blocks is laid over the first course and encompasses at least a portion of the remaining length of the primary reinforcing rods. In the second course, modified masonry blocks are employed which include transverse shallow hollows situated intermediate the upper surface of each transverse web, and into these hollows there is emplaced a steel upper plate. A charge of mortar is introduced into the space within the first and second masonry block courses to envelop the portions of the primary reinforcing rods disposed in the space.

Two different embodiments of the invention, both highly preferred, develop from the basic structure. In the first embodiment, a wooden beam directly overlaying the upper plate is provided and includes a plurality of apertures generally aligned with and larger than the primary reinforcing rods. Also provided is a steel top plate directly overlaying the beam and also including a plurality of apertures generally aligned with and larger than the primary reinforcing rods. In addition, the upper plate itself includes a plurality of apertures generally aligned with and larger than the primary reinforcing rods such that each of the primary reinforcing rods extends with clearance through the upper plate, the beam and the top plate. Each of the primary reinforcing rods of the first embodiment is threaded to receive a nut along its upper terminal portion which extends above the top plate such that nuts may be threaded onto the primary reinforcing rods and tightened to compress the lintel system into a rigid structure.

In the second embodiment, the lintel system includes a plurality of steel secondary reinforcing rods welded to the lower face of the upper plate and extending vertically downwardly into the interior space of the two courses of masonry blocks. A plurality of steel studs are welded to the upper face of the upper plate and extend vertically upwardly through the apertures in the beam and the top plate such that nuts may be threaded onto threaded terminal portions of each stud and tightened to compress the lintel system into a rigid structure.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 2 is a reoriented partial view taken in the region indicated at 2 in FIG. 1 and showing certain of the internal structure of the first embodiment of the invention;

FIG. 3 is a cross sectional view taken along the lines 3—3 of FIG. 2 and further illustrating certain aspects of the internal structure of the first embodiment of the subject lintel system;

FIG. 4 is an exploded view illustrating the configuration of certain principal components of the lintel system;

DETAILED DESCRIPTION OF THE INVENTION

Figure 1:
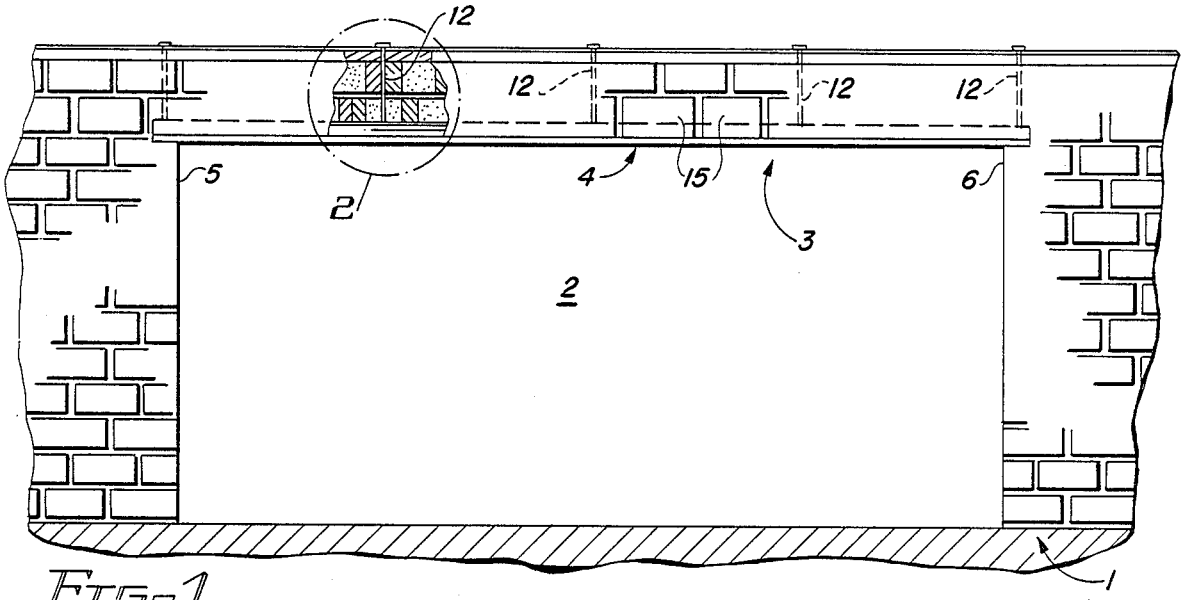
FIG. 1 is a partially broken away pictorial illustrating a completed lintel system prepared in accordance with a first embodiment of the invention and spanning an exemplary garage door opening.

Referring now to FIG. 1, there is shown a masonry edifice wall 1 having a relatively wide opening 2 which may be, merely by way of example, a garage door opening. A lintel system 3 according to the present invention is employed to span the top of the opening 2 and to provide super incumbent support above the opening.

Referring now to FIGS. 2, 3 and 4 as well as to FIG. 1, a first embodiment of the invention will now be described. In this first embodiment, the lintel system includes a flange plate 4 which is adapted to rest on the wall adjacent both sides 5, 6 of the opening 2 to span the opening. The flange plate 4, as best shown in FIG. 4, has upper and lower faces 5, 6 which are generally parallel to one another and generally parallel elongated side edges 7, 8.

Elongated reinforcing structure 10 is fixed to the flange plate 4 on its upper face 5 intermediate the side edges 7, 8. The elongated reinforcing structure 10 has a cross section generally in the shape of an inverted "U". The flange plate 4 and reinforcing structure 10 are each preferably fabricated from steel such that the two elements may be permanently joined by welds 11 which may be either continuous or discretely spaced along the length of the welded together assembly.

Welded at 14 to the apex of the inverted "U" reinforcing structure 10 are a plurality of steel primary reinforcing rods 12 which are distributed along the length of the reinforcing structure and extend upwardly in a direction perpendicular to the parallel faces 5, 6 of the flange plate 4. Each of the primary reinforcing rods 12 is threaded along an uppermost terminal portion 13 to receive a nut 14 during the process of preparing the lintel system for reasons which will become more apparent below. During the preparation of the lintel system 1, the flange plate 4/reinforcing structure 10/primary reinforcing rods 12 assembly will have been assembled and welded together as previously described This operation, as well as similar operations to be described below, may be conducted off site to effect a substantial degree of prefabrication.

Once the prepared lower assembly has been emplaced across the span at the top of the opening 2, a first course of special lintel masonry blocks 15 is laid over the assembly. Each of the special lintel masonry blocks 15 is particularly characterized as having an elongated cavity 16 opening long the full length of its lower surface 17 and having an inverted "U" cross section, the cavity being dimensioned and configured to readily receive a corresponding length of the reinforcing structure 10. It will be apparent than when the first course of masonry blocks 15 has been laid over the flange plate 4, the lower portions of the primary reinforcing rods 12 will be encompassed within the interior of the masonry blocks.

Next, a second course of masonry blocks 18 is laid over the first course of masonry blocks 15 to encompass a portion of the remaining length of the primary reinforcing rods 10 extending upwardly from the first course of masonry blocks 15. The blocks 18 of the second course may be somewhat modified from conventional masonry blocks in that each includes transverse webs 19 having transverse shallow hollows 20 situated intermediate the upper surface of each of the transverse webs. As best shown in FIG. 4, one particularly preferred embodiment of the invention, the masonry blocks 15 and 18 may be identical or, as shown in FIG. 2, may be different having the respective lower and upper special characteristics enumerated above. Another masonry block shape which permits the use of identical blocks in both courses will be discussed below.

The purpose of the shallow hollows 20 is to receive and support a steel upper plate 21. The upper plate 21 has generally parallel upper and lower faces 22, 23, and parallel elongated side edges 24, 25. The thickness of the upper plate 21 is about equal to the depth of the hollows 20 to provide a substantially flush upper surface to the second course of mortar blocks 18 with the upper plate in place.

Next, a beam 26, which may be fabricated from wood, directly overlays the upper plate 21. Both the upper plate 21 and the beam 26 are provided with a plurality of apertures 21*a*, 26*a* generally aligned with and larger than the primary reinforcing rods 12. Similarly, a steel top plate 27 overlays the beam 26 and is also provided with a plurality of apertures 27*a* generally aligned with and larger than the primary reinforcing rods. If each of the primary reinforcing rods 12 is of sufficient length to extend with clearance through the aligned apertures 21*a*, 26*a* and 27*a* in the upper plate 21, beam 26, and top plate 27, then nuts 14 may be threaded onto the terminal portions 13 of the primary reinforcing rod 12 and tightened to compress the lintel system into a rigid structure. Preferably, washers are situated between the nuts 14 and the top plate 27 in the conventional fashion.

However, prior to emplacing the upper plate 21, beam 26 and top plate 27, a charge of mortar 28 is introduced into the interior of the first and second masonry block courses 15, 18 filling the internal space and enveloping the portions of the primary reinforcing rods 12 disposed therein and also the lower face 23 of the upper plate 21. Subsequently, the lintel system assembly is completed such that, when the charge of mortar cures into concrete, a very strong installation will have been achieved.

Figure 5:
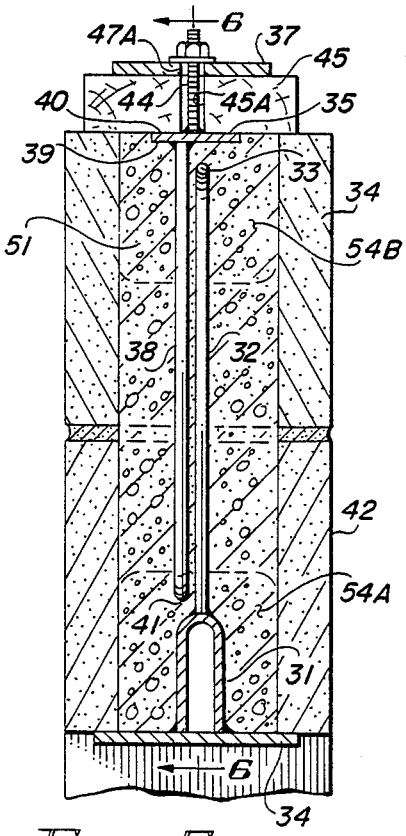
FIG. 5 is a cross sectional view illustrating a lintel system according to a second embodiment of the invention.
Figure 6:
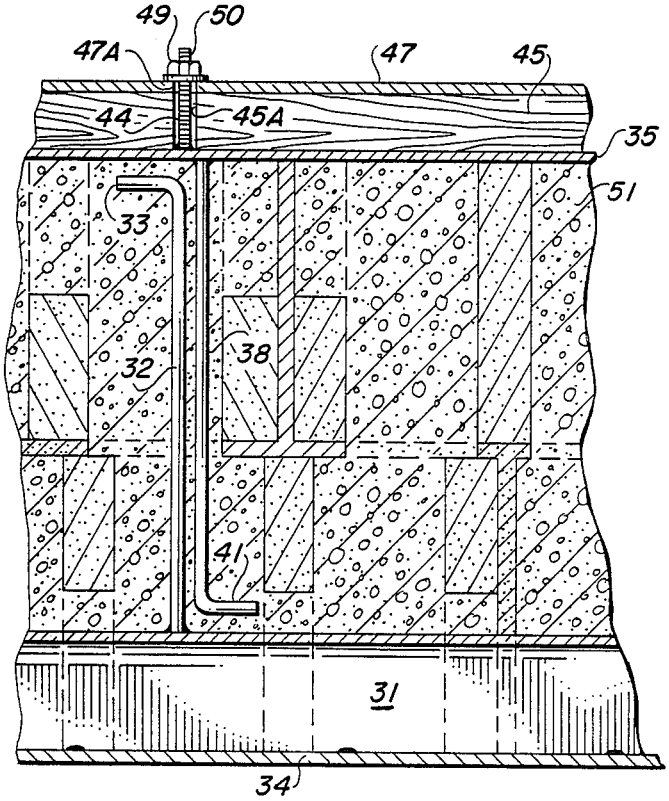
FIG. 6 is a partial view taken along the lines 6—6 of FIG. 5 and illustrating a transverse cross sectional view of the second embodiment of the invention.

Turning now to the alternative embodiment of the subject invention which is best shown in FIGS. 5 and 6, flange plate 30 and inverted U-shaped reinforcing structure 31 directly correspond to the flange plate 4 and reinforcing structure 10 illustrated in FIGS. 2, 3 and 4. Similarly, but not identically, primary reinforcing rods 32 extend upwardly at intervals from the apex of the inverted reinforcing structure 31. However, it will be noted that the upper terminals 33 of the primary reinforcing rods 32 do not extend above the upper surface of the second course of masonry blocks 34, but instead terminate within the interior space thereof. Preferably, the upper terminals 33 are bent at about a right angle to enhance the tensile and compression strength of the completed lintel system. Overlaying the second course of building blocks 34 are an upper plate 35, beam 45 and top Plate 37. However, the assembly including the upper plate 35 differs substantially from the upper plate 21 illustrated in FIGS. 2 and 3 and previously described.

Thus, still referring to FIGS. 5 and 6, a plurality of secondary reinforcing rods 38 are welded to and distributed along the length of the lower face 39 of the upper plate 35 and extend downwardly in a direction perpendicular to the parallel faces 39, 40 of the upper plate. The lower ends 41 of the secondary reinforcing rods 38 terminate within the interior space within the first course of masonry blocks 42 laid over the flange plate 30 and are also preferably bent at about a right angle. Desirably, the distribution of the primary reinforcing rods 32 and secondary reinforcing rods 38 is are such that individual reinforcing rods 32, 38 are closely juxtaposed in pairs as best seen in FIG. 6. The reason for this preferred configuration will become apparent below.

A plurality of studs 44 having threaded outboard ends 50 are welded at their lower ends to the upper face 40 of the upper plate 35 and extend upwardly in a direction perpendicular to the parallel faces of the upper plate. A beam 45 directly overlays the upper plate 35 and includes a plurality of apertures 45a aligned with and larger than the studs 44. A top plate 47 overlays the beam 45 and is also provided with a plurality of apertures 47*a* aligned with and larger than the studs 44. As a result, the studs 44, if of sufficient length to extend with clearance through the aligned apertures 45*a*, 47*a* in the beam 45 and top plate 47, a nut 49 may be threaded onto each of the threaded ends 50 of the studs 46 to press the lintel system into a rigid structure. It will be appreciated by those skilled in the art that some or all the assembly including the upper plate 35, secondary reinforcing rods 38, studs 44, beam 45, top plate 47 and nuts 49 may be fabricated off site, and it is contemplated that at least the unitary welded structure of the upper plate, secondary reinforcing rods and studs will be.

In general similarity to the first embodiment, prior to final assembly to the uppermost sections of the lintel system, a charge of mortar 51 is introduced into the interior space of the first and second courses of masonry blocks 42, 34 enveloping the juxtaposed primary and secondary reinforcing rods 32, 38 to provide a very strong and rigid structure when the mortar cures into cement. In effect, as a result of their close juxtaposition and the right angle configuration of their free ends 33, 41, adjacent pairs of primary and secondary reinforcing bars 32, 38 are coupled together.

Figure 7:
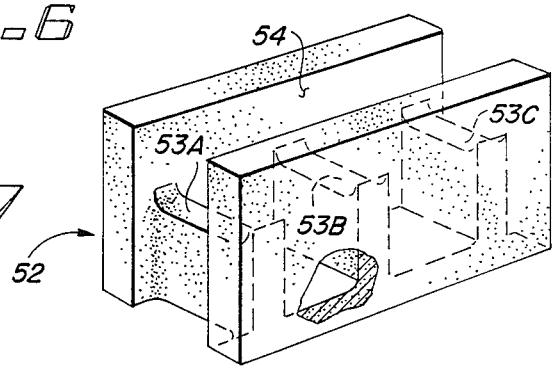
FIG. 7 is a partially broken away pictorial illustrating a second configuration for a special lintel masonry block which may be used in the practice of the invention.

While the special lintel masonry blocks previously described in conjunction with the first embodiment of the invention, another particularly configured masonry block 52, best shown in FIG. 7, is especially well adapted for use in both the first and second courses of blocks 42, 34 in the second embodiment of the invention. The block 52 is particularly characterized in having each of its transverse webs 53*a*, 53*b*, 53*c* extending only about half the full height of the block to leave a complementary open region 54. As a result, as best understood by reference to FIG. 5, the height of the reinforcing structure 31 is readily accommodated if the open region 54*a* is placed down in the first course of blocks 42. Then, the identical style of block may be used for the second course of blocks 34 if the blocks in the second course are oriented with the open region 54*b* placed up. It will be noted that the upper plate 35 is supported by the beam 45 resting on the top edges of the second course of blocks outboard the open region 54*b* since the entire upper assembly will routinely be emplaced as a prepared unit.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. A lintel system for spanning the top of an opening in a wall and providing superincumbent support, said lintel system comprising:

(A) a flange plate adapted to rest on the wall adjacent both sides of the opening to span the opening, said flange plate having generally parallel upper and lower faces and parallel elongated side edges;

(B) an elongated reinforcing structure integral with said flange plate, said reinforcing structure having a cross section generally in the shape of an inverted "U" and being fixed to said upper face of said flange plate at a position intermediate said side edges;

(C) a plurality of primary reinforcing rods fixed to said reinforcing structure, said primary reinforcing rods being distributed along the length of said reinforcing structure and extending upwardly in a direction perpendicular to said parallel faces of said flange plate;

(D) a first course of masonry blocks laid over said flange plate and encompassing said primary reinforcing rods along a lower portion of their respective lengths said first course employing special lintel masonry blocks;

(1) each said special lintel masonry block having an elongated cavity opening from the full length of its lower surface and having an inverted "U" cross section dimensioned and configured to receive a corresponding length of said reinforcing structure;

(E) a second course of masonry blocks laid over said first course and encompassing at least a portion of the remaining length of said primary reinforcing rods extending upwardly from said special lintel masonry blocks, said second course employing modified masonry blocks;

(1) each said modified masonry block including transverse webs and transverse shallow hollows situated intermediate the upper surface of each said transverse web;

(F) an upper plate adapted to rest within said transverse hollows of said masonry blocks of said second course, said upper plate having generally parallel upper and lower faces and parallel elongated side edges, said upper plate having a thickness equal to the depth of said hollows; and (G) a charge of mortar filling said first and second masonry block courses and enveloping the portions of said primary reinforcing rods disposed therewithin and said lower face of said upper plate.

2. The lintel system of claim 1 which further includes:

(A) a beam directly overlaying said upper plate and including a plurality of apertures generally aligned with and larger than said primary reinforcing rods; and (B) a top plate directly overlaying said beam and including a plurality of apertures generally aligned with and larger than said primary reinforcing rods;

and in which:

(C) said upper plate includes a plurality of apertures generally aligned with and larger than said primary reinforcing rods;

(D) each of said primary reinforcing rods is of sufficient length to extend with clearance through aligned ones of said apertures in said upper plate, said beam and said top plate;

(E) each of said primary reinforcing rods is threaded to receive a nut along a terminal portion extending above said top plate; and (F) a nut is threaded onto said terminal portion of each said primary reinforcing rod and tightened to compress said lintel system into a rigid structure.

3. The lintel system of claim 1 which further includes:

(A) a plurality of secondary reinforcing rods fixed to said lower face of said upper plate, said secondary reinforcing rods being distributed along the length of said upper plate and extending downwardly in a direction perpendicular to said parallel faces of said upper plate;

(B) a plurality of studs fixed to said upper face of said upper plate, said studs being distributed along the length of said upper plate and extending upwardly in a direction perpendicular to said parallel faces of said upper plate;

(C) a beam directly overlaying said upper plate and including a plurality of apertures generally aligned with and larger than said studs; and (D) a top plate directly overlaying said beam and including a plurality of apertures generally aligned with and larger than said studs;

and in which:

(E) each of said studs is of sufficient length to extend with clearance through aligned ones of said apertures in said beam and said top plate;

(F) each of said studs is threaded to receive a nut along a terminal portion extending above said beam; and (G) a nut is threaded onto said terminal portion of each said stud and tightened to compress said lintel system into a rigid structure.

4. The lintel system of claim 1 in which:

(A) said flange plate, said reinforcing structure, said primary reinforcing rods and said upper plate are fabricated from steel; and (B) said flange plate, said reinforcing structure and said primary reinforcing rods are welded together to form a unitary structure.

5. The lintel system of claim 2 in which:

(A) said flange plate, said reinforcing structure, said primary reinforcing rods, said upper plate and said top plate are fabricated from steel; and (B) said flange plate, said reinforcing structure and said primary reinforcing rods are welded together to form a unitary structure.

6. The lintel system of claim 3 in which:

(A) said flange plate, said reinforcing structure, said primary reinforcing rods, said upper plate, said secondary reinforcing rods, said studs and said top plate are fabricated from steel;

(B) said flange plate, said reinforcing structure and said primary reinforcing rods are welded together to form a first unitary structure; and (C) said upper plate, said secondary reinforcing rods and said studs are welded together to form a second unitary structure.

7. A lintel system for spanning the top of an opening in a wall and providing superincumbent support, said lintel system comprising:

(A) a flange plate adapted to rest on the wall adjacent both sides of the opening to span the opening, said flange plate having generally parallel upper and lower faces and parallel elongated side edges;

(B) an elongated reinforcing structure integral with said flange plate, said reinforcing structure having a cross section generally in the shape of an inverted "U" and being fixed to said upper face of said flange plate at a position intermediate said side edges;

(C) a plurality of primary reinforcing rods fixed to said reinforcing structure, said primary reinforcing rods being distributed along the length of said reinforcing structure and extending upwardly in a direction perpendicular to said parallel faces of said flange plate;

(D) a first course of masonry blocks laid over said flange plate and encompassing said primary reinforcing rods along a lower portion of their respective lengths, said first course employing special lintel masonry blocks;

(1) each said special lintel masonry block having an open region obtained by extending transverse webs thereof only about one/half the height of said special lintel masonry blocks; and (2) each said special lintel masonry blocks in said first course being laid with said open region thereof facing downward;

(E) a second course of said special lintel masonry blocks laid over said first course and encompassing the remaining length of said primary reinforcing rods extending upwardly from said first course of said special lintel masonry blocks;

(1) each said special lintel masonry block in said second course being laid with said open region thereof facing upward;

(F) an upper plate overlaying said masonry blocks of said second course, said upper plate having generally parallel upper and lower faces and parallel elongated side edges;

(G) a plurality of secondary reinforcing rods fixed to said lower face of said upper plate, said secondary reinforcing rods being distributed along the length of said upper plate and extending downwardly in a direction perpendicular to said parallel faces of said upper plate;

(H) a plurality of studs fixed to said upper face of said upper plate, said studs being distributed along the length of said upper plate and extending upwardly in a direction perpendicular to said parallel faces of said upper plate;

(I) a beam directly overlaying said upper plate and including a plurality of apertures generally aligned with and larger than said studs;

(J) a top plate directly overlaying said beam and including a plurality of apertures generally aligned with and larger than said studs;

(K) each of said studs:

(1) being of sufficient length to extend with clearance through aligned ones of said apertures in said beam and said top plate; and (2) being threaded to receive a nut along a terminal portion extending above said beam;

(L) a nut threaded onto said terminal portion of each said stud and tightened to compress said lintel system into a rigid structure; and (M) a charge of mortar filling said first and second masonry block courses and enveloping the portions of said primary reinforcing rods disposed therewithin and said lower face of said upper plate.

8. The lintel system of claim 7 in which:

(A) said flange plate, said reinforcing structure, said primary reinforcing rods, said upper plate, said secondary reinforcing rods, said studs and said top plate are fabricated from steel;

(B) said flange plate, said reinforcing structure and said primary reinforcing rods are welded together to form a first uitary structure; and (C) said upper plate, said secondary reinforcing rods and said studs are welded together to form a second unitary structure.

* * * * *